United States Patent [19]

Kato et al.

[11] Patent Number: 4,696,245

[45] Date of Patent: Sep. 29, 1987

[54] METHOD OF AUTOMATIC BUTTONHOLE STITCHING WITH A COMPUTERIZED SEWING MACHINE

[75] Inventors: Kenji Kato; Yasuro Sano, both of Tokyo, Japan

[73] Assignee: Janome Sewing Machine, Co. Ltd., Tokyo, Japan

[21] Appl. No.: 765,875

[22] Filed: Aug. 14, 1985

[30] Foreign Application Priority Data

Aug. 17, 1984 [JP] Japan ..... 59-170431

[51] Int. Cl.[4] ..... D05B 3/06

[52] U.S. Cl. ..... 112/264.1; 112/447; 112/456

[58] Field of Search ..... 112/447, 453, 456, 454, 112/264.1, 266.1, 65, 68

[56] References Cited

U.S. PATENT DOCUMENTS 4,159,685 7/1979 Wurst et al. ..... 112/447

4,502,401 3/1985 Asai et al. ..... 112/447

*Primary Examiner*—Peter Nerbun

*Attorney, Agent, or Firm*—Michael J. Striker

[57] ABSTRACT

In a computerized sewing machine, initial coordinate values of amplitudes of needle drops (the stitching width) for line-and bar tacks of a buttonhole are stored in a ROM. Desired stitching amplitude values and cut width values are selected by external setting means on the machine and stored in a RAM. The stored desired data are adjusted to coordinates of the present initial values in such a manner that selected needle drop or stitching amplitude values are offset in parallel relative to a center value of a maximum stitching amplitude available in the machine. The widths of stitches of the left-and right line tacks remain unchanged for different cut widths of a buttonhole and only the amplitudes of the bar tack stitches are adjusted to a particular cut width.

4 Claims, 7 Drawing Figures

(1) Read cutting width
(2) Indicate cutting width
(3) Push B2
(4) Synchronizing pulse
(5) S1 stitch 1 step
(6) Bartack
(7) S2 stitch 2 step
(8) Stitching number of bartack
(9) Left-right convert output of S1 stitch linetack
(10) Push B3
(11) Finish-up stitch

(15) Power source initially
(18) Read out offset $\alpha_x$ $P_3=P_3+\alpha_x$ $P_4=P_4-\alpha_x$
(19) Output of preceding P3
(5) S1 stitch 1 step
(8) Stitching number of bartack
(22) Read out basic data of linetack
(23) Read out reduction rate K
(24) Read out offset $\alpha_x$
(25) Output preceding P1
(26) Output P1 stitching
(27) Output P2 stitching (1) Read cutting width
(2) Indicate cutting width
(3) Push $B_2$
(4) Synchronizing pulse
(5) $S_1$ stitch 1 step
(6) Bartack
(7) $S_2$ stitch 2 step
(8) Stitching number of bartack
(9) Left-right convert output of $S_1$ stitch linetack
(10) Push $B_3$
(11) Finish-up stitch

(15) Power source initially
(18) Read out offset $\alpha_x$ $P_3=P_3+\alpha_x$ $P_4=P_4-\alpha_x$
(19) Output of preceding $P_3$
(5) $S_1$ stitch 1 step
(8) Stitching number of bartack
(22) Read out basic data of linetack
(23) Read out reduction rate K
(24) Read out offset $\alpha_x$
(25) Output preceding $P_1$
(26) Output $P_1$ stitching
(27) Output $P_2$ stitching

METHOD OF AUTOMATIC BUTTONHOLE STITCHING WITH A COMPUTERIZED SEWING MACHINE

FIELD OF THE INVENTION

This invention relates to a method of automatic buttonhole stitching of a computerized sewing machine.

BACKGROUND OF THE INVENTION

U.S. Pat. No. 4,159,685 discloses a buttonhole stitching in an electronic control sewing machine, where amplitudes of left and right line tacks are adjusted while the maximum amplitude of the buttonhole stitchings is utilized, in order to control the cut width.

The cut width of the buttonhole is generally determined in dependence upon the thickness of a button, shrinkage of stitches due to the sort of a fabric to be sewn and other factors. If the cut width is changed, the width of each of the line tacks is made different, and the resulting shapes of the buttonholes are not appealing in aesthetic appearance.

SUMMARY OF THE INVENTION

The present invention adjusts the cut width of the buttonhole, while fixing the amplitudes of the left and right line tacks, so that the aesthetic balance of the buttonhole is maintained, and functional sizes of the stitching parts are secured, thereby enabling to form desirable buttonholes.

DETAILED DESCRIPTION OF THE INVENTION

Figure 2:
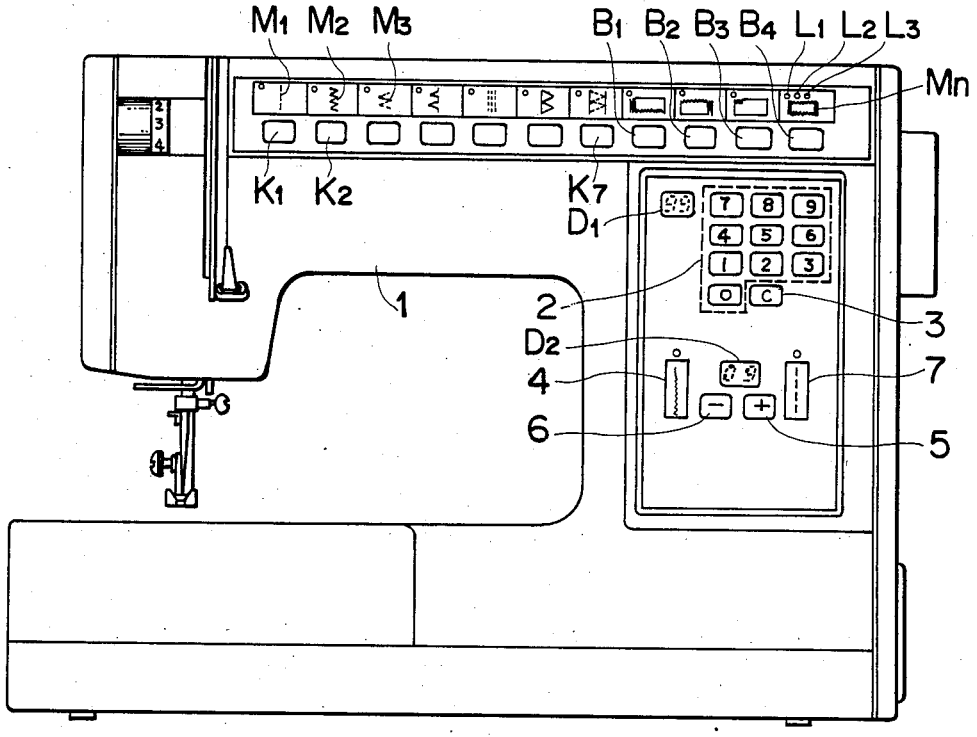
FIG. 2 is a front and outer view of a sewing machine according to the present invention.

In FIG. 2, there are, at the upper front part of the sewing machine, provided pattern selecting keys (K1) to (K7) and (B1) to (B3) for selecting a fist pattern group of stitchings which are frequently used. The keys (B1) to (B3) select stitches of a stitching process. A cut width adjusting key (B4) changes a designation of the cut width of the buttonhole. Pattern indicators (M1) to (Mn) are each printed in correspondence to the pattern selecting keys (K1) to (K7) and (B1) to (B4). Cut width indicating lamps (L1) (L2) (L3) indicate respectively small, middle or large sizes of the cut width of the button-hole in response to the designation of the cut width adjusting key (B4).

On the column of the machine body 1 there are provided, a key board 2 and a clear key 3 for selecting a second pattern group which is less frequently used. The selection is made by designating numerals of two figures. Pattern indicators pertaining to the second group are each printed on the rear side of a top plate of the sewing machine (not shown) is correspondence to the stitching pattern number. An indicator (D1) shows memory data with the numeral of two figures for the pattern number or buttonhole stitching number dewsignated by the key board 2.

An amplitude adjustment designating key 4 enables to adjust the amplitude of the selected pattern, and the amplitude is increased by operating a plus key 5 and is decreased by a minus key 6. An indicator (D2) shows with the numeral of two figures, the adjusted amplitudes or stitching widths (S) of the buttonhole stitching. A feed adjustment designating key 7 enables adjustments by the keys 5, 6.

Figure 3:
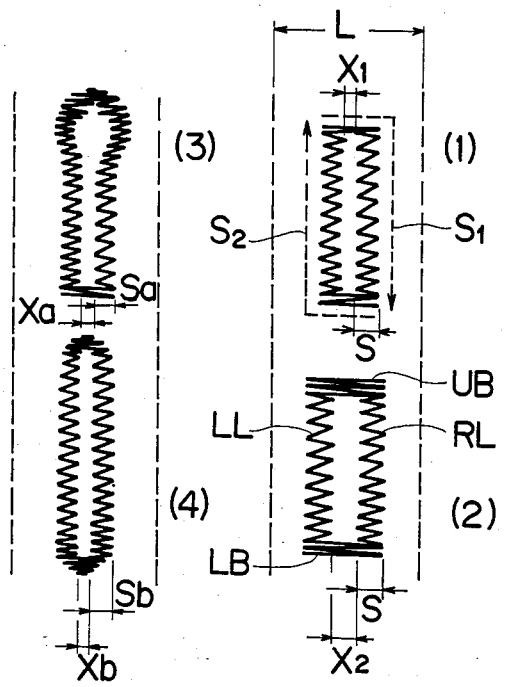
FIG. 3 is an explanatory view of shapes and formations of buttonholes.

FIG. 3 shows shapes of the buttonholes, in which (1) and (2) are ordinary types of buttonhole stitchings, (3) is a key hole type, and (4) is a round end type. The cut width (X2) of (2) is larger than the cut width (X1) of (1). The width (L) is the maximum amplitude available to the sewing machine. The stitching width or amplitude (s) of the right line tack (RL) and the left line tack (LL) is of the same size if the cut width is changed. However, the lower bar tack (LB) and the upper bar tack (UB) change amplitudes in response to an adjustment of the cut width.

The button holes according to FIGS. 3 (3) and (4) do not show changes of the cut widths (Xa) and (Xb). The amplitudes (Sa) and (Sb) of the line tacks are the same in size.

Figure 4:
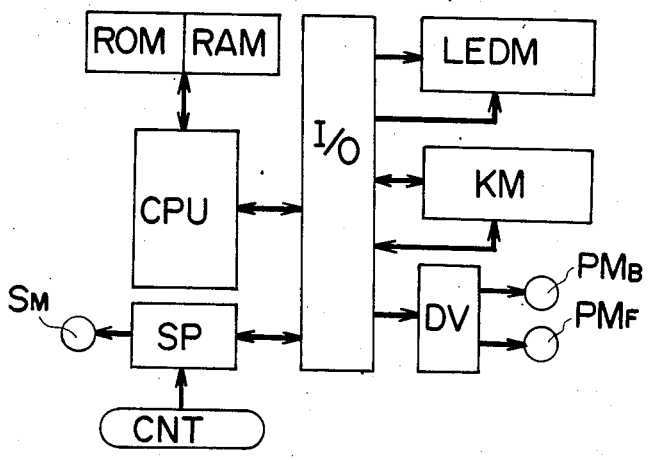
FIG. 4 is a block diagram of a control circuit for line tacks.

FIG. 4 is a block diagram of a control circuit including a micro-computer composed of a central processing unit (CPU), a read-only-memory (ROM), a random-access-memory (RAM) and an input-output unit (I/O). a key matrix (KM) is composed of pattern selecting keys (K1) to (K7) and (B1) to (B3), ten keys of keyboard 2, adjusting keys (B4), 4 and 7, and its operation is controlled by the micro-computer. The read only memory ROM stores both control data for different sticth patterns to be selectively produced and program data for controlling the production of a selected stitch pattern. The central processing unit CPU carries out in conventional manner the program control of the microcomputer. The random access memory RAM temporarily stores selected input data entered via key matrix (KM) and also stores under the control of CPU the calculated results of program processes which will be explained below in connection with FIGS. 1(A) and 1(B). An indication matrix (LEDM) is composed of indicators (D1)(D2), lamps (L1)(L2)(L3), and shows results of the control by the micro-computer. A drive device (DV) is controlled by the micro-computer so as to drive a needle amplitude control pulse motor ($PM_B$) and a fabric feed control pulse motor ($PM_F$). A spped controller (SP) is controlled by the micro-computer in accordance with the operation of the controller (CNT) so as to contril the speed of the sewing machine (SM).

Figure 5:
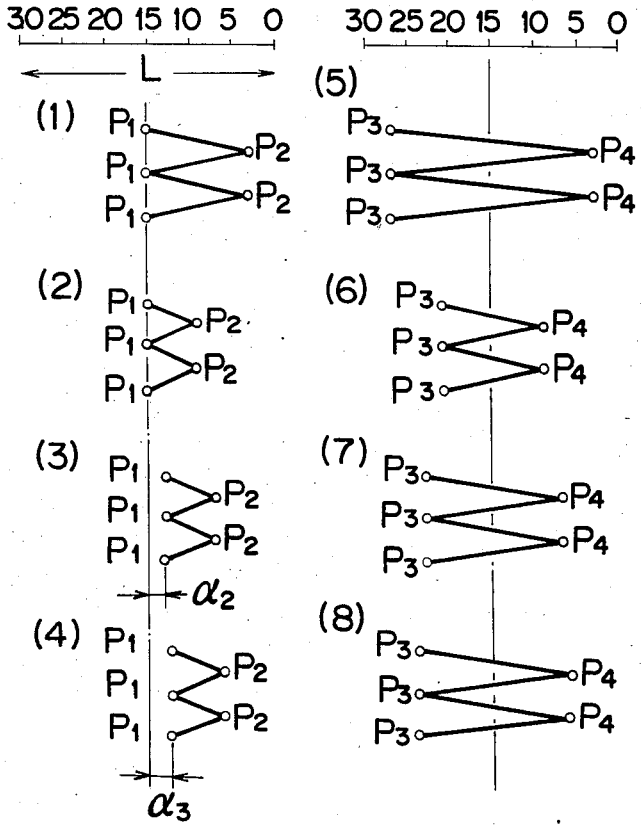
FIG. 5 is an explanatory view showing an embodiment of controlling buttonhole stitchings.

FIG. 5 is an explantory view of controlling coordinates of buttonhole stitching, wherein FIG. 5(1) shows stitching of the right line tack RL corresponding to the basic data of the right line tack of Table 1. In the amplitude stitch coordinates, the maximum amplitude of stitches is (L), the right end is 0, the left end is 30 and the center is 15. In the corresponding feed coordinates, the maximum forward feed is 30, the maximum backward feed is 0, and the feed 0 is 15. In FIG. 5(1), the central needle drop coordinate (P1) is the center 15, and the right needle drop coordinate (P2) is 3. FIG. 5(2) shows that the pattern of FIG. 5(1) is reduced in amplitude relative to the standard center 15 by combined actuation of the amplitude adjustment designating key 4 and the plus key 5 or the minus key 6. FIGS. 5(3) and 5(4) show that the cut width adjustment key (B4) the stitchings of FIG. 5(2) are moved to the right in parallel by the offset amount $\alpha 2$ or $\alpha 3$ upon the operation of the cut width adjustment key (B4). the calculation of the amplitude of the right line tack depends upon a formula $Pn=15-K(15-Wn)-\alpha x$ (herein n=1,2). For Wn, the amplitude data of Table 1 are used. K is a reduction rate, and is stored in the memory (ROM). An initial setting value is 0.5, and the values of from 0.5 to 1 may be designating by 5 steps in the operation of the amplitude adjustment designating key 4 and the plus key 5 or the minus key 6. $\alpha x$ is the offset amount and is stored in the memory (ROM), and a value 20C X is the cut width. The initial setting value is 2, and the values of from 1 to 3 may be designated in 3 steps by the operation of the cut width adjustment key (B4).

FIGS. 5(5) (6), 15 (7) and 5 (8) respectively correspond to K=1, $\alpha x=0$, and K=0.5, $\alpha x=0$, and K=0.5, $\alpha x=2$, and K=0.5, $\alpha x=3$. In table 1, the amplitude data of W2 is 3, because when K=1 and $\alpha x=3$, the needle dropping coordinate (P2) is 0 and the needle dropping coordinates may be set within the maximum amplitude (L) by and designations. FIG. 5(5) shows stitchings of the upper bar tack UB corresponding to the basic data of the upper bar tack of Table 2 stored in the memory (ROM). In FIG. 5(5), the needle dropping coordinate (P3) of the left side is 27, and the needle dropping coordinate (P4) is 3 in correspondence to the needle dropping coordinate (P2) of FIG. 5(1). FIGS. 5(5) (6) (7) and (8) respectively are correlated to FIG. 5(1) (2) (3) and (4). The calculation for the amplitude depends upon the formula $P3=15+K(W3-15)+\alpha x$, and $P4=15-K)15-W4)-\alpha x$, and the reduction rate K and the offset amount $\alpha x$ of the same FIGS.(5) and (6) (7) and (8) may be applied with the values of FIGS. 5(1) (2) (3) and (4).

TABLE 1

| Stitching number | Amplitude data | Marks | Feed data (Reference) |
|---|---|---|---|
| 1 | 15 | $W_1$ | 18 |
| 2 | 3 | $W_2$ | 18 |
| 3 | 15 | $W_1$ | 18 |

TABLE 2

| Stitching number | Amplitude data | Marks | Feed data (Reference) |
|---|---|---|---|
| 1 | 27 | $W_3$ | 18 |
| 2 | 3 | $W_4$ | 18 |
| 3 | 27 | $W_3$ | 18 |
| 4 | 3 | $W_4$ | 18 |

Figure 1A:
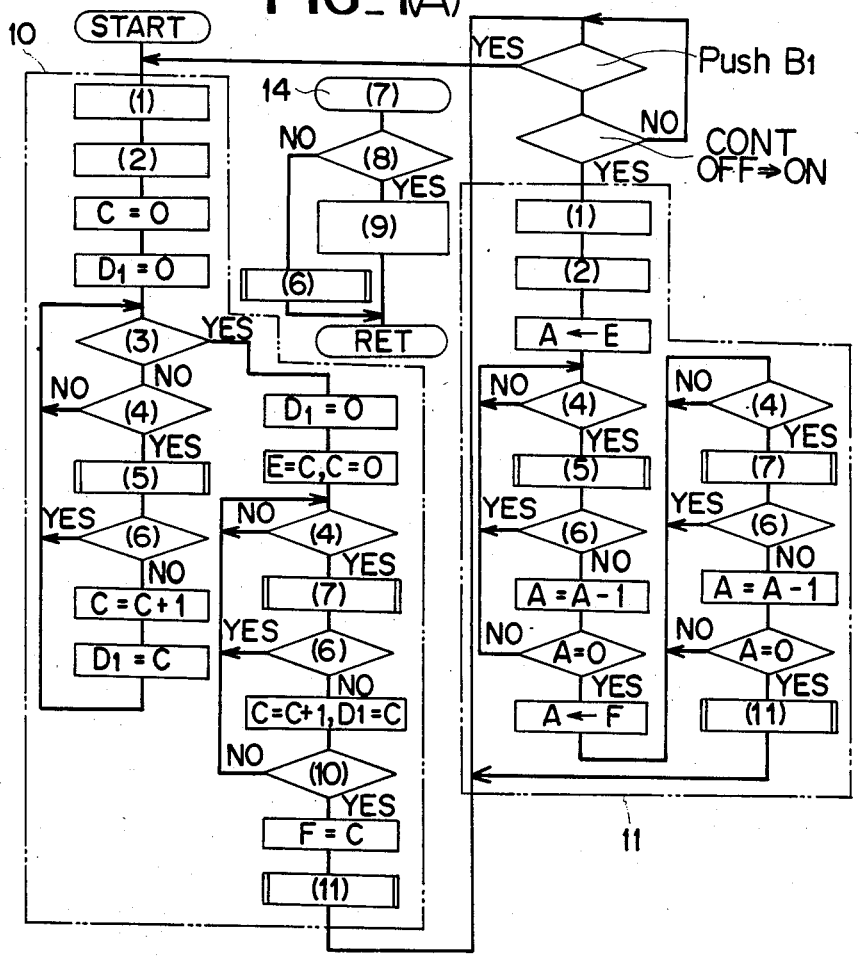
FIG. 1A and 1B show a control flow chart of an embodiment of the invention.
Figure 1B:
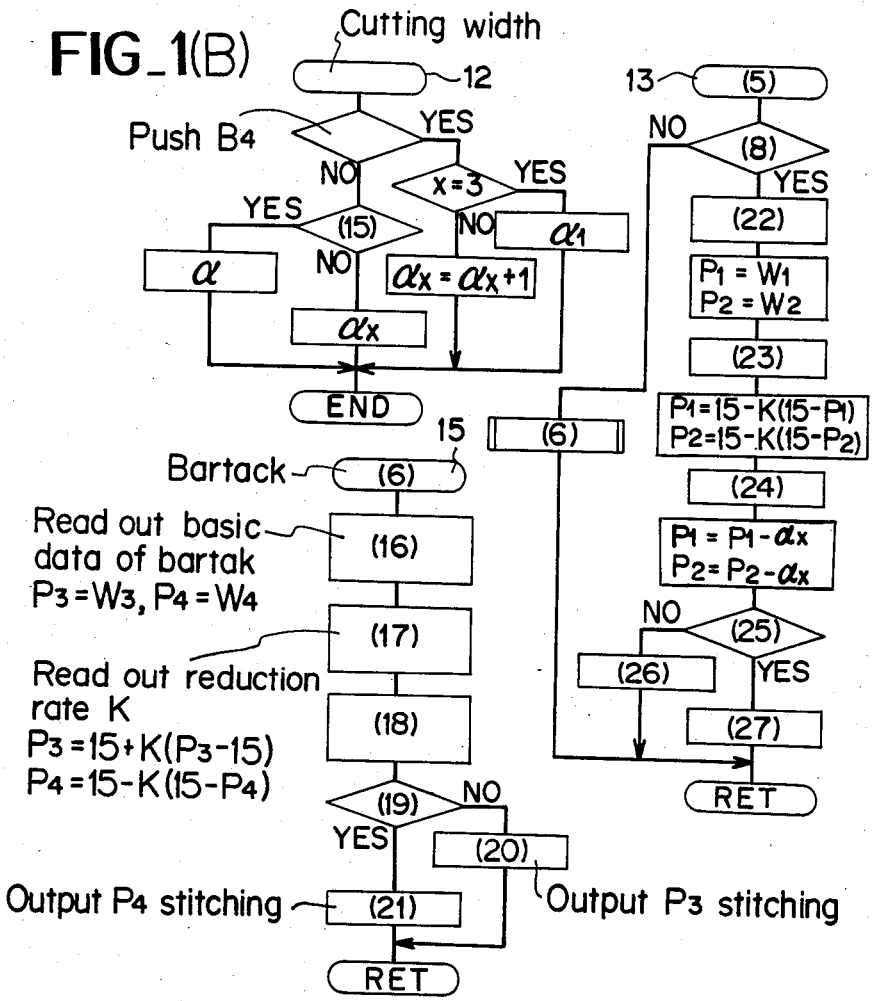

The operation of the circuit of FIG. 4 will be explained with reference to the control flow chart of FIGS. 1(A) and (B). In the latter Figures, a process designated with the reference numeral 10 represents a control part of trial stitching; the numeral 11 designates a control part of an automatic buttonhole stitching by reproduction; the reference numeral 12 indicates a control part of registration of setting the cut width; the reference numeral 13 designates a subroutine corresponding to "S1 :stitch 1 step" of the control parts 10 and 11; the reference numeral 15 shows a subroutine corresponding to "bar tack" of the control parts 13 and 14.

When a key (B1) for the 1st step S1 of the buttonhole stitching is operated, the program starts. The control part 10 for trial stitching reads in the offset amount $\alpha x$ for the cut width. The cut width is controlled in the process 12 shown in FIG. 1(B). This routine is automatically performed at key-scanning which is carried out in a certain period. At an initial period of applying a power source, $\alpha x=\alpha 2=2$ is registered and the lamp (L2) for indicationg the cut width is lighted. The stitching count (C) is reset to 0, the number of the indicator (D1) is 0. A stitch control signal is read out from the memory (ROM) per each of the pulses synchronizing the rotation of the upper shaft of the sewing machine, and the stitch of the 1st step (S1) is formed. The bar tack LB of the subroutine 13 is performed by the process of 15. The basic data W3 and W4 of the bar tack of Table 2 and the reduction rate K are read out, and the offset amount $\alpha x$ by the process 12 is read out. In this case, the initially setting values are K=0.5 and $\alpha x=\alpha 2=2$. According to a formula of $P3=15+K(W3-15)+\alpha x$ and $P4=15-K(15-W4)-\alpha x$, the amplitude coordinates (P3),(P4) of the needle dropping points are calculated and stored in the, and in this case the bar tack of FIG. 5(7) is repeatedly formed. When the bar tack reaches the specified stitching number, the right line tack RL is successively formed by the process 13. Similarly, the basic data W1 and W2 of the line tack of Table 1, the fixed reduction rate K and the offset amount $\alpha x$ are read out. The initial setting values are K=0.5 and $\alpha x=\alpha 2=2$. According to the formula $Pn=15-K(15-Wn)-\alpha x$ herein, n=1 and 2), and the right line tack of FIG. 5(3) is formed by the first program process (1). The counter (C) is counted up by the process 10, and its value is shown in the indicator (D1). Subsequently, the right line tack is formed, and the number of the indicator (D) progresses. When the line tack reaches a required stitching number and if the key (B2) for the 2nd step is operated, the indicator (D1) is 0, the value of the preceding count (C) is stored in the register (E), and the count (C) is reset at 0. The stitches of the 2nd step (S2) are formed similarly. No explanations have been made as to the amplitude data of the left line tack and the calculation thereof, but are the calculations carried out by turning over the data of the right line tack. Similarly, when the line tack reaches the required stitching number, and if the key (B3) for the 3rd step is operated, the value of the count (C) is stored in the register (F), and the required finish-up stitch is performed. At this time, if the key (B1) for the 1st step is operated, the trial stitching by the process 10 is redone.

If the controller (CNT) is turned ON without operating the key (B1) for the 1st step, the automatic reproduction buttonhole stitching is performed by the process 11, and the cut width is read in. The lamp (L2) is continuously lighted. The stitches of the 1st step (S1) are formed with stitching number of the right line tack stored in the preceding register (E), and the stitches of the 2nd step (S2) are formed with stitching number of the left line tack stored in the register (F), and the finish-up stitch is performed.

If the key (B4) for the cut width is operated, for example, once, the lamp (L3) for indicating the cut width is lighted by the process 12, and the initial setting value is $\alpha x=\alpha 3=3$. This value is read in by "read cut width" in the process 10 or 11, and reflected in each of the preceding needle dropping coordinates (P1) (P2) (P3) (P4), and controlled to be large as the size of the cut width.

If the reduction rate K is designated by combined actuation of the amplitude adjustment designating key 4 and the plus key 5 or the minus key 5, it is read in "read out the reduction rate K" of each of the processes 13 and 14, and reflected in each of the coordinates, and the buttonhole stitching width is enlarged or reduced.

Figure 6:
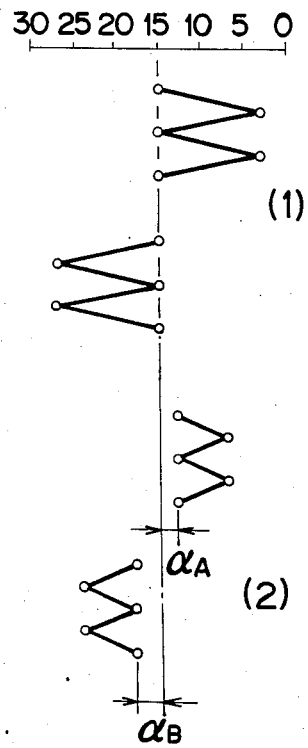
FIG. 6 is an explanatory view showing another embodiment of controlling buttonhole stitchings.

FIG. 6 shows another embodiment relating to the present invention. In the above mentioned embodiment of FIG. 3, with respect to the left line tack of the 2nd steps (S2), the double of the offset amount $\alpha n$ is the cut width set by turning over the right line tack of the 1st step (S1). In the present embodiment, in order to adjust the cut with more finely, the basic data of the amplitudes of the left and right line tacks are, as shown in Table 3, stored in memory (ROM) respectively, while on the other hand, by designating the offset amount $\alpha x$ from $\alpha 1$ to $\alpha 4$, the offset amount $\alpha A$ is applied to the calculation of the coordinate of the right line tack in response to said designation as shown in Table 4, and the offset amount $\alpha B$ is applied to the calculation of the coordinate of the left line tack, and the calculation is made in accordance with the above mentioned formula. As a result, $\alpha A+\alpha B$ is obtained as the cut width.

FIG. 6(1) is correlated to FIG. 5(1), FIG. 6(2) shows that the cut width is 5 under the condition of $\alpha A=2$ and $\alpha B=3$, by designating $\alpha 4$ of Table 4, while FIG. 5(3) shows that the cut width is 4 under $\alpha x=2$.

TABLE 3

| | Stitching Number | Amplitude data |
|---|---|---|
| Right | 1 | 15 |
| | 2 | 3 |
| | 3 | 15 |
| Left | 1 | 15 |
| | 2 | 27 |
| | 3 | 15 |

TABLE 4

| | $\alpha 1$ | $\alpha 2$ | $\alpha 3$ | $\alpha 4$ |
|---|---|---|---|---|
| $\alpha A$ | 1 | 1 | 2 | 2 |
| $\alpha B$ | 1 | 2 | 2 | 3 |
| $\alpha A + \alpha B$ | 2 | 3 | 4 | 5 |

According to the present invention, the cut width may be adjusted while the amplitudes of the right and left line tacks are fixed, and therefore, the appearance of the buttonhole is pretty, and since the above mentioned amplitudes are constant, the strength of the buttonhole is secured.

What is claimed is:

1. In a computerized sewing machine having means for selecting a cut width and amplitude of needle drops for left and right line tacks, and the electronic read only memory (ROM) and a random access memory (RAM), a method of automatically stitching buttonholes comprising the steps of storing in the ROM basic data pertaining to initial amplitude values of a right line tack (RL) and/or a left line tack (LL) of a buttonhole, and initial amplitude coordinate values of an upper bar tack (UB) and/or lower bar tack (LB) pertaining to a present offsetting value ($\alpha x$) of an initial cut width;

selecting a desired cut width and a desired amplitude of needle drops for buttonhole stitchings to be performed, and storing the selected data in the RAM:

computing the adjustment of amplitude coordinate values of said stored selected data relative to amplitude coordinates of stored basic data for offsetting in parallel the selected amplitudes of the needle drops for respective line tacks relative to a standard center of a predetermined maximum amplitude, by amounts each corresponding to half the value of the selected cut width;

adjusting amplitude coordinate values of the bar tacks relative to the standard center in accordance with the selected cut width;

storing the adjusted amplitude coordinate values in the RAM; and automatically stitching the buttonhole in accordance with the stored adjusted amplitude coordinate values.

2. A method as defined in claim 1 wherein said sewing machine has means for selecting a pattern of stitchings and wherein a trial buttonhole is stitched in accordance with the stored basic data and, upon the selection of a pattern, the automatic stitching step is initiated.

3. A method as defined in claim 1, further comprising a step of inverting the needle drops for one of the left and right line tacks laterally of the standard center of the predetermined maximum amplitude to provide the needle drops for other left-and right line tacks.

4. A method as defined in claim 1, wherein said selected data include different rates of the value of the selected cut width.

* * * * *